United States Patent [19]

McCormack

[11] Patent Number: 5,073,688

[45] **Date of Patent: * Dec. 17, 1991**

[54] BODY TEMPERATURE RESPONSIVE TRANSPORT WARMING BLANKET

[76] Inventor: William C. McCormack, 3703 Woodland St., Ames, Iowa 50010

[ * ] Notice: The portion of the term of this patent subsequent to Apr. 16, 2008 has been disclaimed.

[21] Appl. No.: 678,438

[22] Filed: Apr. 1, 1991

[51] Int. Cl.[5] ..... H05B 3/34

[52] U.S. Cl. ..... 219/212; 219/516

[58] Field of Search ..... 219/211, 212, 516, 528, 219/529, 549

[56] References Cited

U.S. PATENT DOCUMENTS

| | | | |
|---|---|---|---|
| 1,356,965 | 10/1920 | Charles | 219/212 |
| 1,358,509 | 11/1920 | Birkenfeld | 219/211 |
| 1,447,181 | 3/1923 | Richmond . | |
| 3,072,776 | 1/1963 | Quenneville . | |
| 3,112,792 | 12/1963 | Coleman | 219/211 |
| 3,141,948 | 7/1964 | Young | 219/494 |
| 3,276,935 | 10/1966 | Dugan | 219/212 |
| 3,338,233 | 8/1967 | Grsholz et al. | 128/1 |
| 3,406,678 | 10/1968 | Hanks | 219/211 |
| 4,132,262 | 1/1979 | Wibell | 165/46 |
| 4,279,255 | 7/1981 | Hoffman | 219/211 |
| 4,359,626 | 11/1982 | Potter | 219/490 |
| 4,517,423 | 5/1985 | Smith, III | 200/52 R |
| 4,532,410 | 7/1985 | Wehmeyer | 219/211 |
| 4,656,334 | 4/1987 | Endo et al. | 219/212 |
| 4,757,804 | 7/1988 | Griffith et al. | 128/1.3 |
| 4,788,417 | 11/1988 | Graflind | 219/212 |
| 5,008,515 | 4/1991 | McCormack | 219/212 |

FOREIGN PATENT DOCUMENTS

| | | | |
|---|---|---|---|
| 979851 | 5/1951 | France | 219/212 |

*Primary Examiner*—Teresa J. Walberg

*Attorney, Agent, or Firm*—Zarley, McKee, Thomte, Voorhees, & Sease

[57] ABSTRACT

An infant warming blanket is servo controlled by a skin contact temperature sensor being taped to the abdominal skin of the infant. Through use of the blanket it is possible to maintain a constant body temperature. Access to localized areas of the body is possible by removal of blanket strips to expose the area requiring attention. The blanket has a first solid section to which a second section of individual strips having varying widths are integrally attached. In a first embodiment, heat is provided by electrical heating elements which run through both sections. Heat is supplied by heated fluid in a second embodiment eliminating the risk of electrical shock.

16 Claims, 2 Drawing Sheets

BODY TEMPERATURE RESPONSIVE TRANSPORT WARMING BLANKET

BACKGROUND OF THE INVENTION

In working with premature and sick infants it is very important that the desired body temperature be consistently maintained. This may also be true with certain older patients such as wet victims and those in shock whose circulation has been compromised.

A particular problem with infants and especially preterm infants is that they will need to be transferred from a hospital lacking equipment and specialists to a hospital that can meet the infant's needs. It is during this transfer that it is critical to maintain consistent skin temperature. A premature child has a large surface-to-volume ratio and heat is lost in proportion to the surface area. Premature infants are especially vulnerable because they do not have the usual subcutaneous fat layer gained in the last month of pregnancy.

A conservative estimate of the number of premature infants who might require such specialized care is 22,000 which is the number born each year in the United States weighing less than 1500 grams. It is estimated that one-third of these may be transferred between hospitals and thus will encounter the body temperature problems discussed. If we consider larger infants and term babies, the number would be much greater and perhaps on the order of 100,000 infants per year.

Visual and hand access to the infant is important. The infant must be watched for changes in skin color, type of breathing, chest respiratory movement, vomiting and convulsions. The various invasive tubes must be watched for proper position and function The endotracheal tube, the intravenous tube, the intraarterial tube, the stomach tube, the urinary catheter, etc. must all be accommodated and serviced. Attention to these items usually means increased exposure to the environmental temperature and increased body heat loss.

The current state-of-the-art includes several unsatisfactory approaches to dealing with this problem. An isolette may be used which is a plastic box supplied with heated air as a means of infant temperature maintenance. Heat loss is by radiation to the walls and by exposure to cool air. Access is limited to arm holes in the sides of the isolette, unless the lid on the box is raised. A transport isolette, which is a modified isolette, is self contained on wheels which includes a respirator, a battery pack, suction apparatus and monitors. The infant is accessed only from above through the raising of a hinged cover. Another approach to this problem is the use of a semitrailer for transport of one or more full sized neonatal intensive care units. The bed surface is about four feet high and the infant is heated by radiant heaters about three to four feet above the bed. The radiant heaters are ineffective as they may be easily blocked by the bodies of medical personnel or drapes or the like.

Known warming pads available have crude control systems that do not respond to changes in body temperature. None of them are thermostatically regulated to keep the patient's skin at a constant temperature. The electrothermal blanket in Charles U.S. Pat. No. 1,356,965 is such a heated blanket. A heating blanket is shown in the Endo U.S. Pat. No. 4,656,334 but the control merely senses the presence of a body under the blanket and turns the setting of the blanket from high to another lower preset temperature. This thermostat is not intended to regulate the body temperature of the occupant but simply keep the blanket from staying uncomfortably hot when the user goes to sleep without requiring the user to turn it down.

SUMMARY OF THE INVENTION

An objective of this invention is to maintain a constant body temperature by monitoring the skin temperature and maintaining it at the desired temperature for the body.

A warming transport blanket is provided which is servo controlled by a skin contact temperature sensor being taped to the abdominal skin of the child In a first embodiment, electrical heating elements provided in the blanket will maintain a constant body temperature for the child as the heating elements will only be operative as required to maintain the desired temperature in response to the infants temperature needs as indicated by the temperature sensor.

The blanket has two sections with the first being solid and the second having a plurality of strips independently operable and adapted to provide access to selected areas of the body wrapped in the blanket. The width of the strips will vary with strips having a smaller width being provided in the area covering the head and neck to provide very localized access to the infant for medical treatment.

In a second embodiment, heat is provided by heated fluid circulated through the blanket. This embodiment has the advantage of reducing the infant's exposure to possible electrical shock. A closed circuit passageway extends throughout the blanket and is returned to a heat source through a check valve whereupon it is pumped through a three-way valve back to the blanket if heat is called for by the temperature sensor on the infant and the temperature control setting. If no heat is required, the heated fluid is returned by the three-way valve to the heat source. Fluid is continuously circulated thereby keeping its temperature constant.

DESCRIPTION OF THE PREFERRED EMBODIMENT

Figure 1:
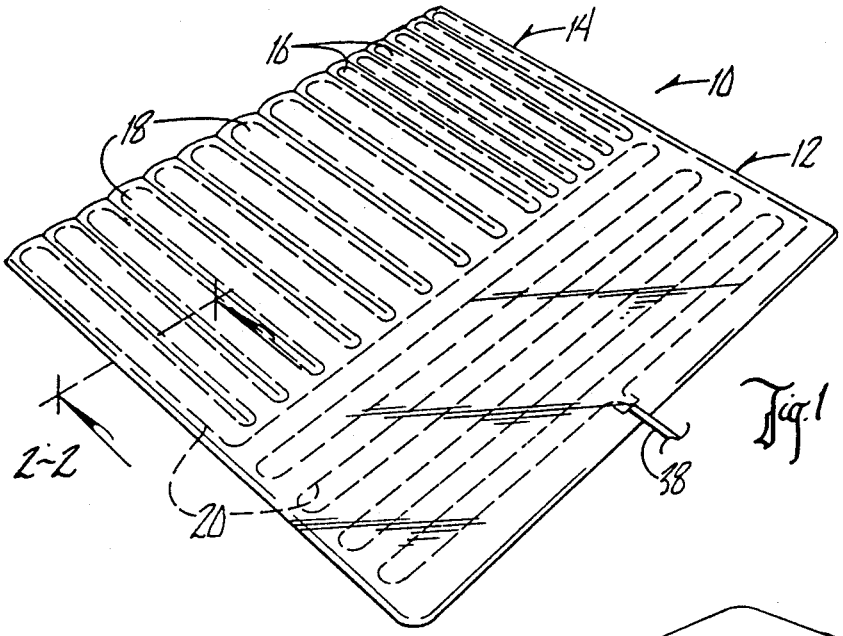
FIG. 1 is a perspective view of the transport warming blanket.

The servo controlled warming blanket of this invention is referred to generally in FIG. 1 by the reference numeral 10 and is seen to have a first section 12 to which a second section 14 is integrally connected. The second section 14 includes a plurality of strips 16 and 18 extending laterally of the longitudinal axis of the blanket. The strips 16 are narrower in width than the strips 18 to provide more localized access to the infant such as in the neck and head area.

Figure 2:
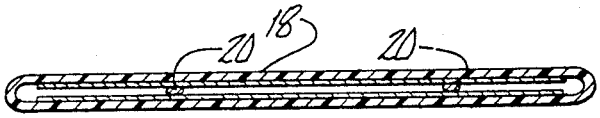
FIG. 2 is a cross-sectional view taken along line 2—2 in FIG. 1.
Figure 3:
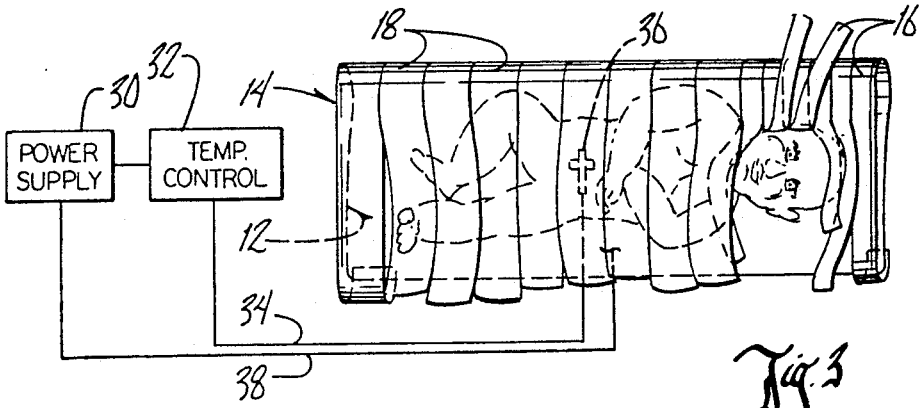
FIG. 3 is a top plan view of the blanket wrapped around a child and additionally showing an electrical schematic.

In the embodiment of FIGS. 1-3, electrical heating elements 20 run throughout both of the sections 12 and 14 to provide heating throughout the entire blanket. The blanket is covered with a plastic material for ease of care and cleanliness. A power supply 30 is seen in FIG. 3 connected to a temperature control 32 which in turn is connected by a conductor 34 to the blanket 10. An abdominal skin contact temperature senor 36 is connected by a conductor 38 to the power supply 30. These controls are available through Ohmeda, Columbia, Md. The heat provided would be proportional heat with zero voltage switching to minimize radiated and conducted EMI. The amount of heat supplied would relate to the amount of heat needed to maintain the desired temperature. If a large amount of heat was required to raise the body temperature a significant amount, then such would be provided but if only a small amount is required a proportionally less amount of heat would be provided. An Ohmeda skin contact temperature sensor model No. LA-003 may be used having a range of 22° C. to 42° C. with an accuracy of ±0.3° C. and a resolution of ±0.1° C. and a probe interchangeability ±0.1° C.

Figure 4:
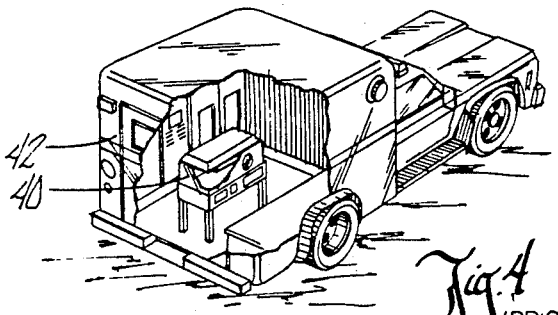
Fig. 4 (PRIOR ART)
FIG. 4 is a perspective view of a prior art vehicle including an isolette.

In use it is seen that the child would be placed on the solid section 12 of the blanket initially with the strips 16 and 18 of section 14 being laid over the top of the infant and then snugly positioned under the section 12 as seen in FIG. 3. The temperature sensor 36 would be attached to the infant's abdominal area by tape and the temperature control would be set to a temperature at which it is desired to maintain the infant's body temperature. Access to the infant is quick and easy by simply lifting one or more of the strips 16 and 18 in the area requiring attention. The infant will not lose significant body heat through this limited exposure Any heat lost which is sufficient to drop skin temperature will be compensated for by the remainder of the blanket still wrapped around the infant. This system avoids the cumbersome and bulky prior art equipment such as shown in FIG. 4 wherein an isolette 40 utilizing convection heat is taken from the hospital and placed in an emergency vehicle 42 for transport of the infant between hospitals. The servo controlled warming blanket of this invention is very flexible such that the infant could even be held on the lap of an adult in the warming blanket while being transported and while maintaining the desired consistent skin temperature.

Figure 5:
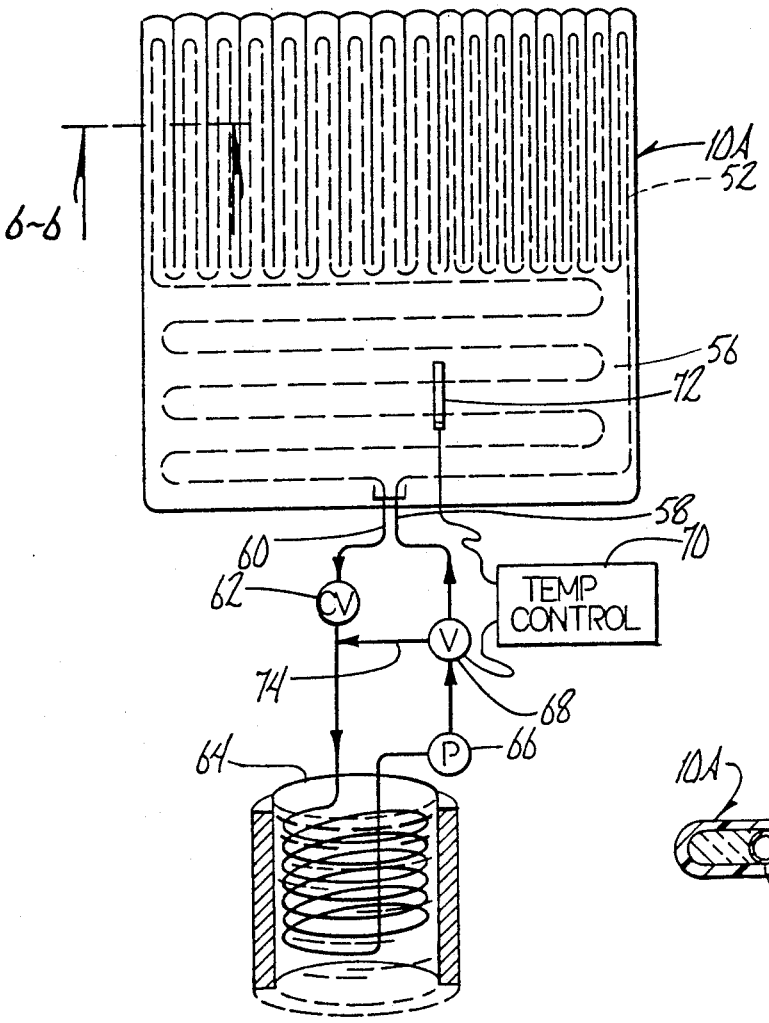
FIG. 5 is a schematic of an alternate embodiment wherein heated fluid is substituted for electrical resistance heating in the blanket.
Figure 6:
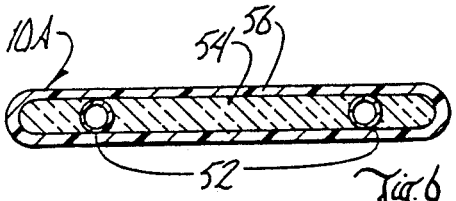
FIG. 6 is a cross sectional view taken along lines 6—6 in FIG. 5 showing a tube in the blanket through which the heated fluid is circulated.
Figure 7:
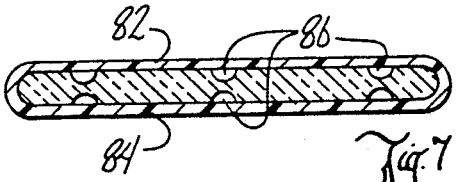
FIGS. 7 and 8 are view similar to FIG. 6 but showing a blanket comprised of a sandwich having fluid channels formed therein.

A second embodiment of the heating blanket is shown in FIGS. 5-7. A blanket 10A includes an endless tube 52 which runs throughout the blanket. The tube 52 is in a center core 54 which is covered by plastic cover 56. Tube 52 has an inlet end 58 and an outlet end 60 which are connected to form a closed circuit. Fluid coming from the blanket 10A through the outlet end 60 flows through a check valve 62 to a heat source 64 whereupon it is moved by a pump 66 to a three-way valve 68. A temperature control 70 is connected between the three-way valve 68 and a skin contact temperature sensor 72 such that in operation the three-way valve 68 will allow heated fluid to flow to the blanket 10A if the temperature sensor 72 and temperature control 70 call for additional heat. At other times the heated fluid will bypass the blanket 10A and flow through a tube 74 and return to the heat source 64. By the heated fluid moving continuously through the heat source 64, it will maintain a constant temperature and when called upon by the blanket 10A will help to assure a constant blanket temperature and thus a constant temperature for the person in the blanket.

It is seen that the person in the blanket is not exposed to any risk of electrical shock. The heat source 64 may include a heated container of liquid, an electrical heater, chemical heaters or a combustion type heater. The blanket 10A thus may be used where electrical energy is not available as a heat source.

Figure 8:
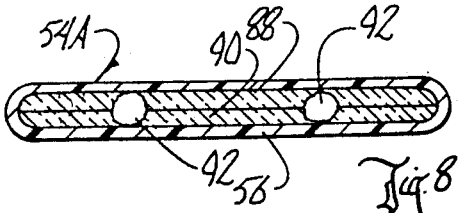

In FIG. 7, an alternate embodiment of the center core 14 of FIG. 6 is shown as core 54 and includes a sandwich of three layers. A center layer 80 is bonded to outside cover layers 82 and 84. The center layer 80 includes an endless open channel 86 running throughout its opposite sides. The sandwich is formed by compressing it in a mold. The outer layers 82 and 84 are of thermoplastic film forming resin. The middle layer 80 is an open cell, reticulated, thermoplastic, thermosetting, load bearing, flow restrictive, foam-like material which will adhere to the outer layers. A variation of the embodiment of FIG. 7 is shown in FIG. 8. The center core 54A is made of two pieces 88 and 90 bonded together to form interconnected passageways 92.

I claim:

1. A body temperature responsive warming blanket comprising, a blanket having a first section integrally connected to a second section, said second section including a plurality of strips independently operable and adapted to provide access to selected areas of the body wrapped in said blanket, heating means extending substantially throughout said first and second sections including said plurality of strips, and a control circuit including said heating means and a skin contact temperature sensor adapted to be attached to said body, and a temperature control means adapted to be adjusted to a predetermined desired body temperature which is substantially continuously maintained throughout operation and use of the blanket by said heating means being operative only as required and indicated by said temperature sensor to maintain said predetermined desired body temperature within a narrow range.

2. The structure of claim 1 wherein said blanket has a longitudinal axis with said plurality of strips extending laterally of the longitudinal axis.

3. The structure of claim 2 wherein said plurality of strips have longitudinal axes and widths which vary thereby being adapted to provide varying amounts of blanket coverage over different parts of said body.

4. The structure of claim 2 wherein said blanket including said plurality of strips has a width sufficient to be adapted to wrap around said body with said strips being overlapped onto said first section of said blanket.

5. The structure of claim 4 wherein said first section is adapted to underlie said body with said second section including said plurality of strips overlying said body and being adapted to be folded back to expose and give access to a selected area of said body.

6. The structure of claim 1 wherein said heating means is further defined as being a heated liquid circulating throughout said blanket.

7. A body temperature responsive warming blanket comprising, a blanket having a heating means extending substantially therethroughout, and a control circuit including said heating means and a skin contact temperature sensor adapted to be attached to said body, and a temperature control means adapted to be adjusted to a predetermined desired body temperature which is substantially continuously maintained throughout operation and use of the blanket by said heating means being operative only as required and indicated by said temperature sensor to maintain said predetermined desired body temperature within a narrow range.

8. The structure of claim 7 wherein said heating means is further defined as being a heated liquid circulating throughout said blanket.

9. The structure of claim 8 and said blanket is further defined as having a passageway therethroughout through which said heated liquid is circulated.

10. The structure of claim 9 wherein said passageway is further defined as being within a tube extending throughout said blanket.

11. The structure of claim 9 wherein said passageway is further defined by said blanket including a sandwich of two layers, one layer having an open channel running therethrough and the second layer covering said open channel to form said passageway.

12. The structure of claim 11 wherein said one layer has oppositely exposed faces with said open channel being in one face and a second open channel being in the other face, and a third layer covering said second open channel.

13. The structure of claim 7 wherein said narrow range of temperature is further defined as being approximately ±0.3° C.

14. The structure of claim 1 wherein said narrow range of temperature is further defined as being approximately ±0.3° C.

15. The structure of claim 9 wherein said passageway is operatively connected to a heat source for warming the liquid in said passageway, and a pump for circulating said liquid.

16. The structure of claim 15 wherein said passageway is a closed circuit including a three-way valve and a check valve, and said temperature control and temperature sensor are operatively connected to said three-way valve whereby heated fluid flows through said three-way valve to said blanket when heat is called for by said temperature control and temperature sensor and at other times said fluid is recirculated back to said heat source, said check valve is connected to said passageway to limit heated liquid flow to flow away from said blanket for return to said heat source.

* * * * *

UNITED STATES PATENT AND TRADEMARK OFFICE

CERTIFICATE OF CORRECTION

PATENT NO. : 5,073,688

DATED : December 17, 1991

INVENTOR(S) : William C. McCormack

It is certified that error appears in the above—identified patent and that said Letters Patent is hereby corrected as shown below:

Column 1, line 43, change "isolette" to read -- incubator --.

Column 1, line 47, change "isolette" to read -- incubator --.

Column 1, line 48, in both occurrences change "isolette" to read -- incubator --.

Column 2, line 52, change "isolette" to read -- incubator --.

Column 3, line 45, change "isolette" to read -- incubator --.

Signed and Sealed this

Fifth Day of July, 1994

Bruce Lehman

BRUCE LEHMAN

*Commissioner of Patents and Trademarks*

*Attest:*

*Attesting Officer*